US005121103A

United States Patent [19]

Minasy et al.

[11] Patent Number: 5,121,103

[45] Date of Patent: Jun. 9, 1992

[54] LOAD ISOLATED ARTICLE SURVEILLANCE SYSTEM AND ANTENNA ASSEMBLY

[75] Inventors: Arthur J. Minasy, Woodbury; Michael N. Cooper, Hewlett, both of N.Y.; Christian Kinnaer, Bonlez, Belgium

[73] Assignee: Knogo Corporation, Hauppauge, N.Y.

[21] Appl. No.: 226,136

[22] Filed: Jul. 29, 1988

[51] Int. Cl.[5] ..... G08B 13/24

[52] U.S. Cl. ..... 340/551; 340/572; 340/584

[58] Field of Search ..... 340/572, 551, 941; 343/841, 842

[56] References Cited

U.S. PATENT DOCUMENTS

| | | | |
|---|---|---|---|
| 3,763,424 | 10/1973 | Bennett, Jr. et al. | 340/551 |
| 4,308,530 | 12/1981 | Kip et al. | 340/572 |
| 4,509,039 | 4/1985 | Dowdle | 343/842 |
| 4,623,877 | 11/1986 | Buckens | 340/572 |
| 4,769,631 | 9/1988 | Copeland | 340/551 |
| 4,859,991 | 8/1989 | Watkins et al. | 340/572 |

FOREIGN PATENT DOCUMENTS

| | | | |
|---|---|---|---|
| 0093281 | 11/1983 | European Pat. Off. | 340/572 |
| 0130286 | 1/1985 | European Pat. Off. | 340/572 |
| 0134087 | 3/1985 | European Pat. Off. | 340/572 |
| 763681 | 5/1934 | France . | |

*Primary Examiner*—Reinhard J. Eisenzopf

*Attorney, Agent, or Firm*—Fitzpatrick, Cella, Harper & Scinto

[57] ABSTRACT

An electronic theft detection system with a transmitter antenna assembly which includes a flat electrically conductive panel positioned close to a transmitter loop antenna to preload it and isolate it from the loading effects of nearby metal objects and a receiver arranged with a signal gate synchronized to the transmitter antenna energization to prevent detection of targets located on the opposite side of the panel from the transmitter loop antenna.

1 Claim, 8 Drawing Sheets 14
16
18
20
22
24
26
27
28
30
34
38

LOAD ISOLATED ARTICLE SURVEILLANCE SYSTEM AND ANTENNA ASSEMBLY

BACKGROUND OF THE INVENTION

1. Field of the Invention

This invention relates to electronic systems for detecting unauthorized movement of articles and more particularly it concerns novel arrangements which isolate such systems from the effects of metal objects and otherwise detectable targets which are close to but not within a predetermined interrogation zone.

2. Description of the Prior Art

Electronic article surveillance systems have been proposed as early as 1934 in French Patent No. 763,681 to Picard. According to Picard there are provided an interrogation loop antenna and a detection loop antenna adjacent an interrogation zone. The interrogation antenna is energized to generate a continuously alternating magnetic field in the interrogation zone. Protected articles are provided with elongated thin strips of an easily saturable magnetic material such as Permalloy which disturbs the magnetic field in the interrogation zone in a distinctive manner by producing characteristic pulses. The detection loop antenna converts the magnetic fields in the interrogation zone to electrical signals and these signals are processed in a receiver system to produce an alarm in response to the occurrence of the characteristic pulses. A modern and commercial magnetic detection system which contains many improvements over the original Picard system is described in U.S. Pat. No. 4,623,877.

In order to generate an interrogation signal of sufficient magnitude for reliable target detection without expenditure of excessive power, the interrogation antenna of most electronic article surveillance systems is arranged as an inductive loop and is connected with a capacitor to form a resonant circuit. In this manner when the system operates at the resonant frequency of the antenna-capacitor combination, a very strong interrogation signal can be produced with minimum expenditure of power.

A problem has been encountered in connection with electronic article surveillance systems which use resonant interrogation antennas. Specifically, these antennas are often used near large metal objects such as checkout counters and the like. The metal objects change the effective inductance of the antenna loop and consequently shift the resonant frequency of the antenna circuit. To some degree it is possible to compensate for this shift by changing the capacitance of the capacitor. However adjustable capacitors are expensive and the range of adjustment is limited. Also, installation of the system requires trained technicians to take proper measurements and make the necessary adjustments; and these measurements and adjustments must be repeated whenever the antenna is moved or whenever there is any change in the amount or nature of the metal objects adjacent the antenna.

Another problem encountered in connection with electronic article surveillance systems is the confinement of the system sensitivity to the interrogation zone. In supermarkets and similar mass retailing operations, the interrogation zone is immediately adjacent a checkout counter and/or conveyor along which legitimately purchased articles must pass. In some instances, the targets on the legitimately purchased articles are deactivated or removed before the articles move along the conveyor adjacent the interrogation zone. However in many instances the targets are not removed or deactivated and it is necessary that these targets be isolated from the detection system so that they do not become detected as they move along the checkout counter behind the interrogation antenna.

SUMMARY OF THE INVENTION

The present invention overcomes the above described problems of the prior art. In one aspect the present invention provides a novel interrogation antenna assembly which is formed as a resonant circuit but which is only minimally affected by the presence of nearby metal objects and which does not require retuning whenever the antenna system or the metal objects are moved. This novel interrogation antenna assembly comprises a transmitter loop antenna lying in a flat plane, a capacitor connected to the transmitter antenna to form a resonant circuit therewith and a flat panel of electrically conductive material extending parallel to and aligned with the loop antenna. The flat electrically conductive panel is positioned close enough to the loop antenna that it inductively couples to the antenna to produce inductive preloading thereof and thus minimize the loading effects of other electrically conductive objects positioned in the vicinity of the loop antenna. Also, the flat electrically conductive panel is spaced far enough for the loop antenna to permit interrogation fields generated by the antenna to extend therefrom in a direction away from the panel.

According to another aspect of the invention there is provided a theft protected store checkout apparatus comprising, in combination, a plurality of spaced apart checkout stations which form parallel passageways between them to allow store customers and their shopping carts to pass through. A plurality of theft detection systems are also provided to detect the presence in respective passageways of targets mounted on articles of merchandise and having special electromagnetic response characteristics. Each theft detection system includes an interrogation antenna assembly positioned alongside each passageway. Each antenna assembly comprises a transmitter loop antenna lying in a flat vertical plane, a capacitor connected to the transmitter loop to form a resonant circuit therewith and a flat panel of an electrically conductive material extending parallel to and aligned with the loop antenna and spaced from the antenna at a distance sufficient to produce inductive loading thereof and thus to minimize the loading effects of electrically conductive objects positioned in the vicinity of the antenna. The panel of each antenna assembly is spaced far enough from the antenna to permit interrogation fields generated by the antenna to extend a substantial distance into its respective passageway. The panels are located farther from their respective passageways than their associated antennas.

According to a further aspect of the present invention there is provided a novel electronic interrogation system which comprises a transmitter antenna assembly in the form of a flat inductive loop coupled to a capacitor to form a resonant circuit and a flat, electrically conductive panel spaced apart from but positioned parallel to and aligned with the inductive loop. A receiver loop antenna is arranged parallel to and is aligned with the transmitter assembly inductive loop on the same side of the flat panel on the transmitter assembly inductive loop.

A signal generator is provided to energize the transmitter antenna assembly at its resonant frequency and a receiver is connected to the receiver loop antenna to process electrical signals generated by the receiver loop antenna and to detect those signals which result from the presence of a detectable target in the vicinity of the antennas. The receiver includes gates synchronized with the signal generator to permit detection only of signals which occur at predetermined phase relationships relative to the phase of the signal generator.

BRIEF DESCRIPTION OF THE DRAWINGS

FIG. 6 is a partially exploded perspective view of the antenna assembly of FIG. 5;

DETAILED DESCRIPTION OF THE PREFERRED EMBODIMENTS

Figure 1:
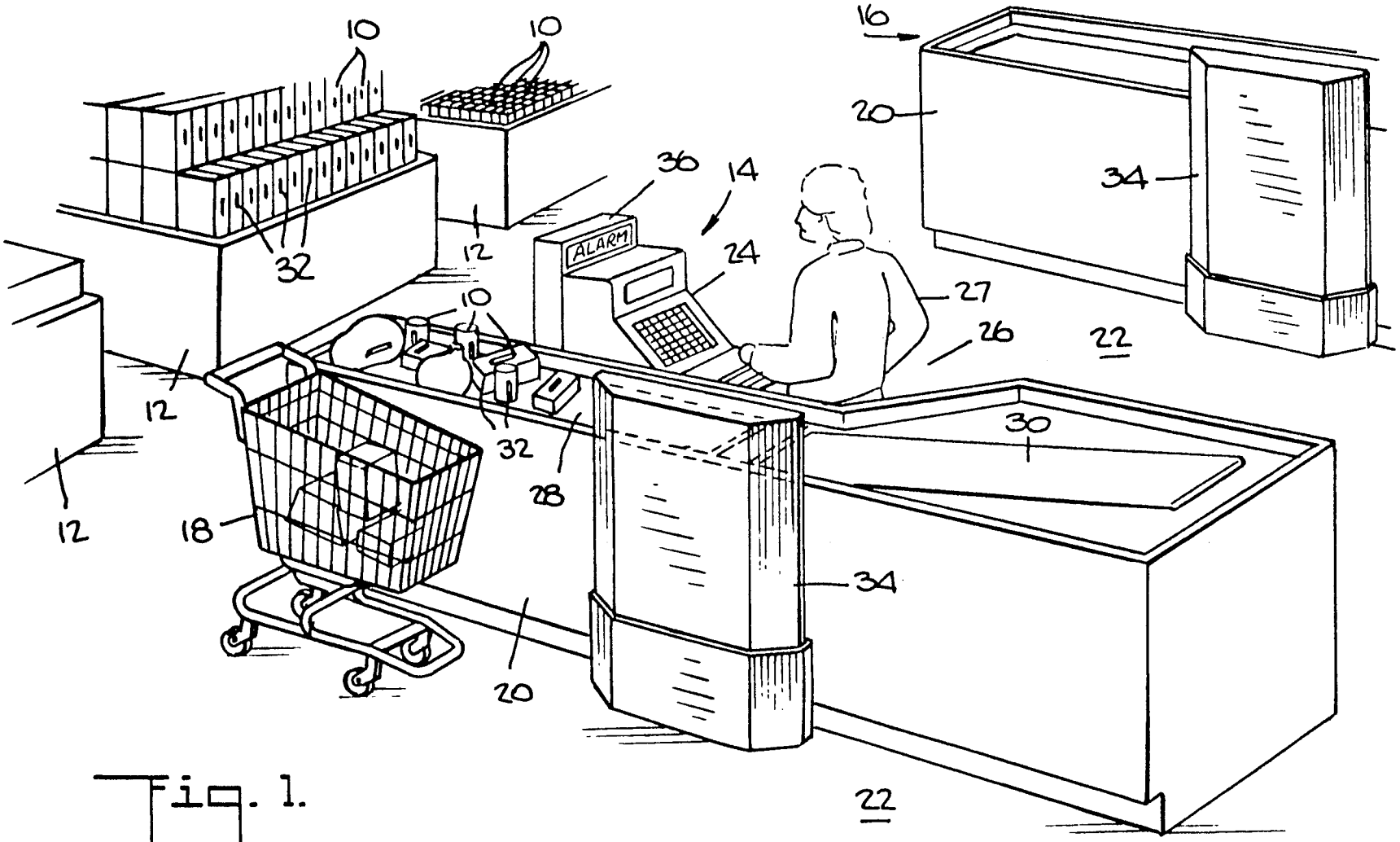
FIG. 1 is a perspective view of a portion of a supermarket checkout area provided with a theft detection system according to the present invention.

Referring first to FIG. 1 there is shown the interior of a supermarket checkout area which is normally located near the exit of a supermarket or similar type of self serve store. As in the usual case, such stores have articles of merchandise, such as packages 10, stacked in bins 12 or in shelves (not shown) and store patrons select the articles or packages they wish to purchase and bring then to checkout stations 14, 16 etc. where they pay for the merchandise and have it bagged or wrapped. Often shopping carts 18 are provided for the convenience of customer to hold selected packages 10 while the customer is making further selections. When the customer has made all of his or her selections, the customer brings the shopping cart 18 carrying the selected packages 10 to one of the checkout stations 14, 16, etc. for payment and wrapping.

The checkout stations 14, 16 etc. each comprise an elongated counter 20 along one side of which is a passageway 22 through which the customer and his or her shopping cart 18 pass as they exit from the store. A cash register 24 is mounted on the other side of the counter 20 and a recess 26 is provided in the counter 20 for a store clerk 27 who checks packages on the counter and operates the cash register.

A first belt type conveyor 28 extends between one end of the counter 20 and the region where the cash register 24 is located and a second conveyor 30 extends from the cash register 24 to the other end of the counter. Often an automatic label reader (not shown) is mounted in the counter to read and record information present on labels attached to the selected merchandise as it is moved between the conveyors 28 and 30.

When a store customer has selected the merchandise he or she wishes to purchase, the customer brings the shopping cart to the counter 20 and places the selected packages 10 onto the first conveyor 28. The store clerk 27 then operates the conveyor to bring the packages to the cash register 24. The clerk then either rings up the price of each package on the cash register or moves each package over the label reader to record the price automatically. Then the clerk places the packages or the second conveyor 30 which brings the packages to the other end of the counter 20 where they are bagged or wrapped.

As can be seen in FIG. 1, several checkout stations 14, 16, etc. may be provided and are arranged parallel to each other so that several customers may check out their purchases at any given time.

An electronic theft detection system is incorporated into the checkout stations 14, 16 etc. The electronic theft detection system detects targets 32 which have been attached to the packages 10. The targets 32 comprise a circuit or an element having a unique electromagnetic response characteristic such that in the presence of an interrogating electromagnetic field it disturbs that field in a distinctive manner. In the illustrated system the targets each comprise an elongated strip of a high magnetic permeability, easily saturable, magnetic material, such as Permalloy. In the presence of an alternating magnetic field such targets are driven alternately from magnetic saturation in one direction to magnetic saturation in the opposite direction. As a result the targets produce electromagnetic disturbances at frequencies which are harmonics of the interrogating field. These disturbances are detected and processed in a receiver system.

When the packages 10 are placed on the counter 20 they are either deactivated by special deactivation devices (not shown) under the control of the store clerk 26 or they are simply passed along the counter 20 out of the presence of any interrogation fields.

An antenna assembly 34 is positioned on the aisle side of the counter 20. As will be described more fully hereinafter, this antenna assembly includes a transmitter antenna for generating an alternating magnetic interrogation field in the associated passageway 22 and a receiver antenna for receiving electromagnetic fields in the passageway and converting them into corresponding electrical signals. Appropriate electrical circuits (not shown) for energizing the transmitter antenna and for processing the electrical signals produced by the receiver antenna are also provided. These electrical circuits may be housed in the base of the antenna assembly 34 or they may be mounted in or adjacent to the counter 20. Except as described herein these electrical circuits are well known per se and are not critical to this invention. Such circuits may, for example, be the same as described in detail in U.S. Pat. No. 4,623,877. An alarm sign 36 may be provided at or near the cash register 24 to alert the clerk when the system has detected the passage of a protected package 10 on the aisle side of the antenna assembly 34, rather than on the counter side.

Figures 2, 3, 4:
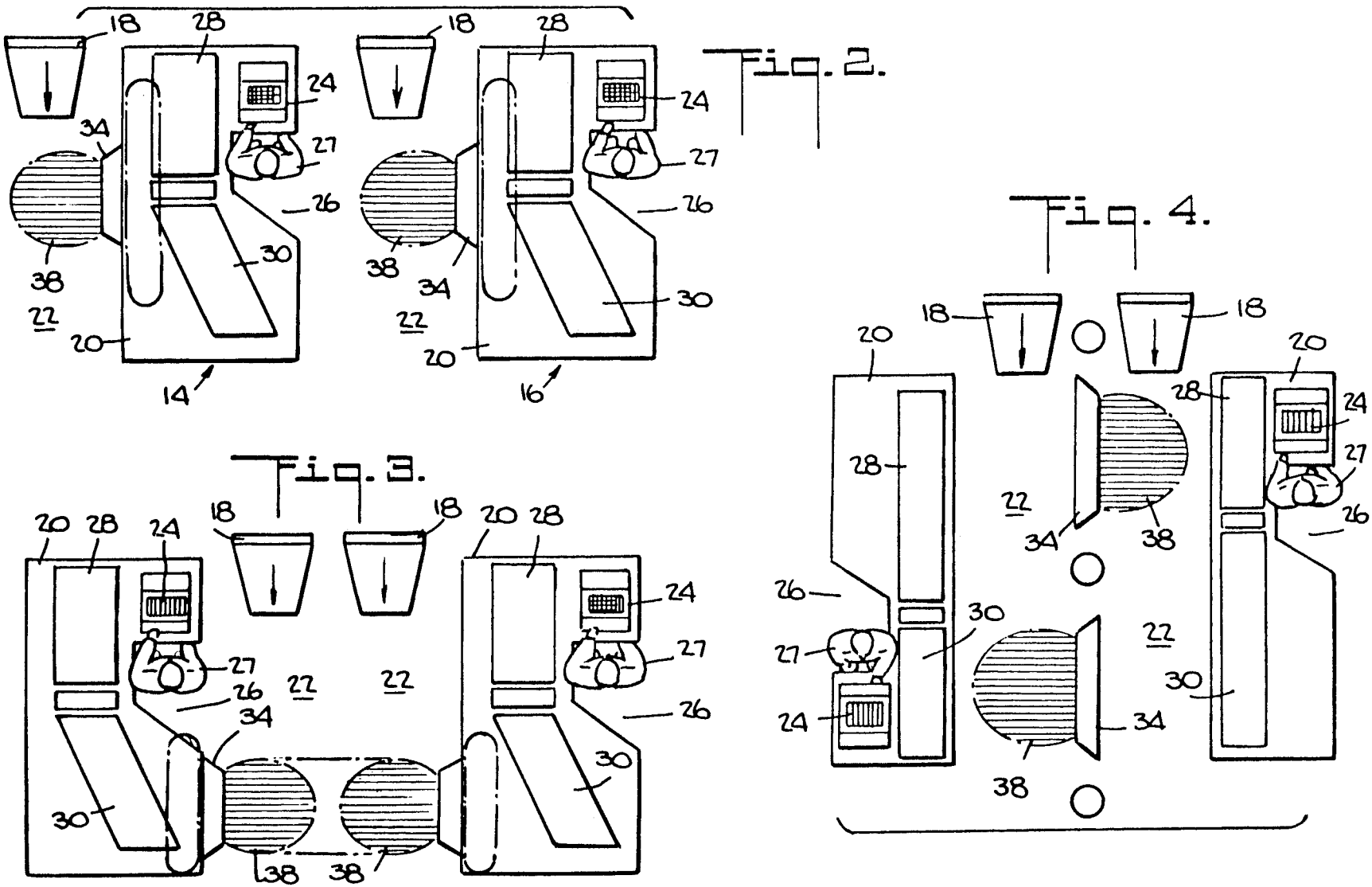
FIG. 2 is a plan view of the supermarket checkout area of FIG. 1 showing two checkout aisles.
FIG. 3 is a plan view similar to FIG. 2 showing an alternate checkout aisle arrangement.
FIG. 4 is a plan view similar to FIG. 2 showing a second alternate checkout aisle arrangement.

In accordance with this invention, the antenna assembly 34 is constructed in a manner such that it is almost completely isolated, electromagnetically, from the counter 20. Thus, even though the counter 20 may be partially or entirely made of metal, it does not affect the operation of the detection system; nor is the system operation influenced by bringing other large metal objects close to the antenna. The antenna assembly 34 of this invention also forms a precisely defined interrogation zone or region of sensitivity. As shown in FIG. 2 this region which is indicated by shading 38, is confined to the passageway 22 along which store customers must pass when checking out their purchases before leaving the store. Moreover, even though the antenna assembly 34 is positioned adjacent to the counter 20, its region of sensitivity does not extend in the direction of the counter. Thus, articles of merchandise 10 which are on the counter 20 during checkout can pass very close to the antenna assembly 34 without causing an alarm to be activated.

FIG. 3 shows a normal parallel arrangement of supermarket checkout stations 14 and 16 which are spaced apart from each other to form parallel passageways 22 of sufficient width to allow a shopping cart 18 to pass through. As can be seen from the shaded areas 36 the region of sensitivity of the antenna assemblies 34 is confined precisely to their respective passageways. Thus, neither antenna assembly will cause detection of protected packages 10 which are located on the counters 20 or which pass through an adjacent passageway.

Because the antenna assembly 34 permits precise confinement of the area of sensitivity it is possible to arrange checkout stations such that the respective passageways 22 of two adjacent stations 14 and 16 may be located immediately adjacent each other. This permits extra wide objects to be carried out between the adjacent checkout stations. At the same time the alarm system for each checkout station will detect only the passage of protected articles through its own respective passageway and will not interfere with the detection of articles in the adjacent passageway by the alarm system at the other checkout station.

FIG. 4 shows a still further arrangement wherein the antenna assemblies 34 are positioned across the passageway 22 from their respective checkout stations. As can be seen, because of the precisely defined region of sensitivity of each antenna assembly 34, neither assembly causes detection of protected articles in the other passageway even though the antenna assembly is positioned immediately adjacent that other passageway.

Figure 5:
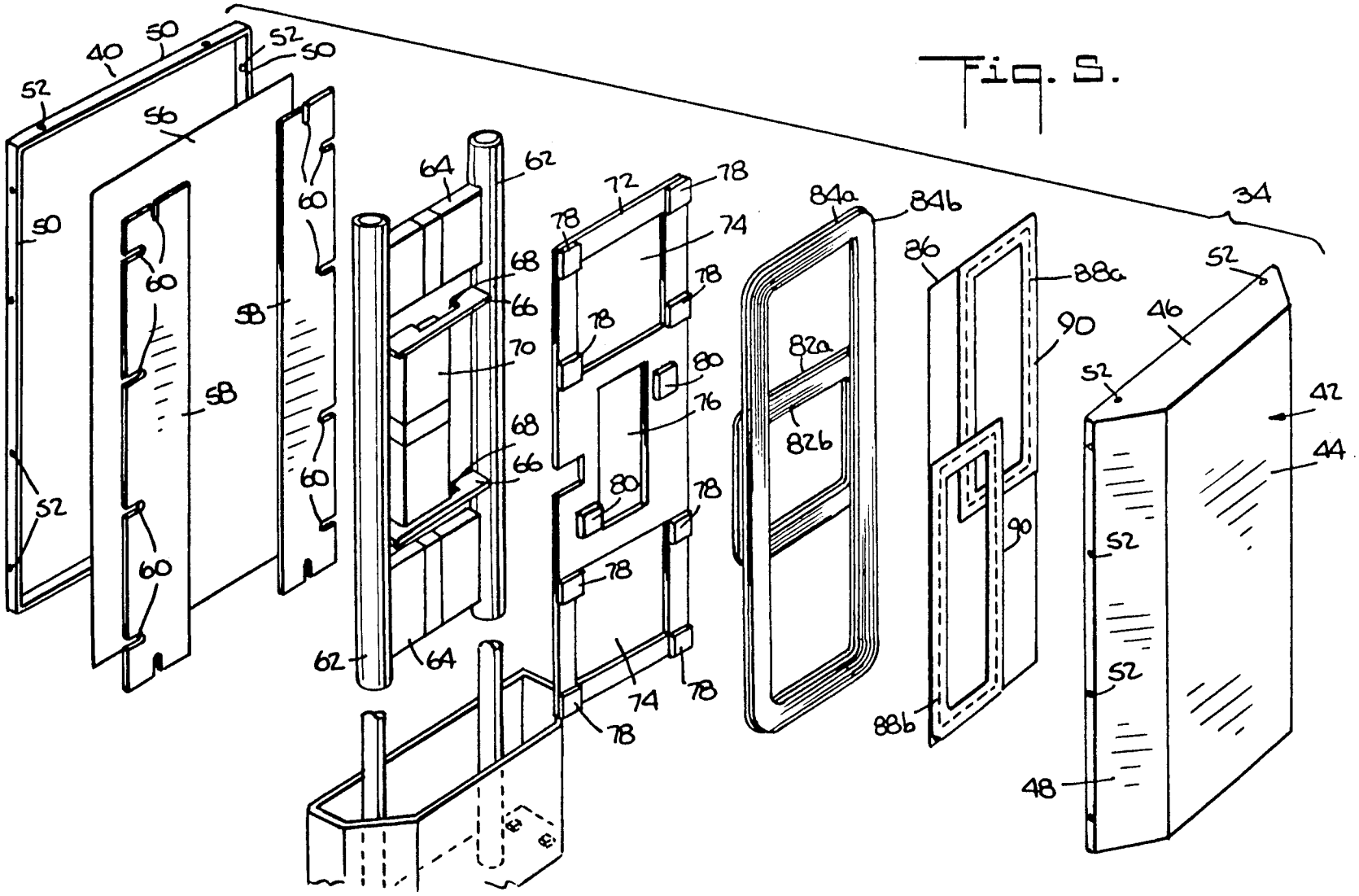
FIG. 5 is a fully exploded perspective view showing the construction of an antenna assembly used in the theft detection system of FIGS. 1-4.
Figure 7:
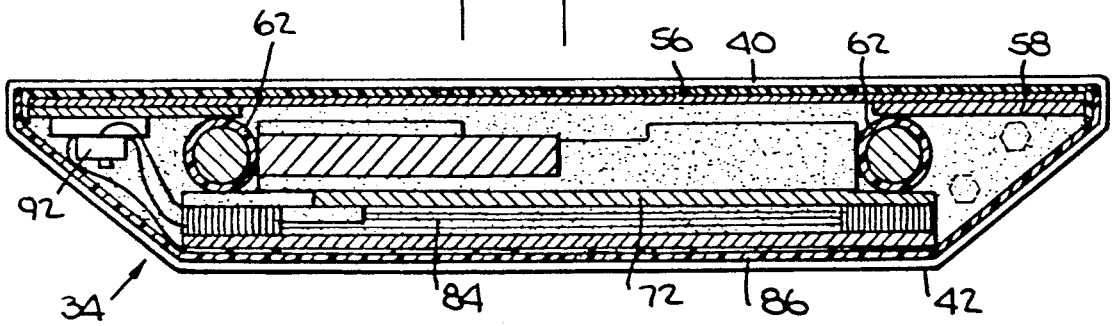
FIG. 7 is a horizontal section view of the antenna assembly of FIGS. 5 and 6 in fully assembled condition.
Figure 8:
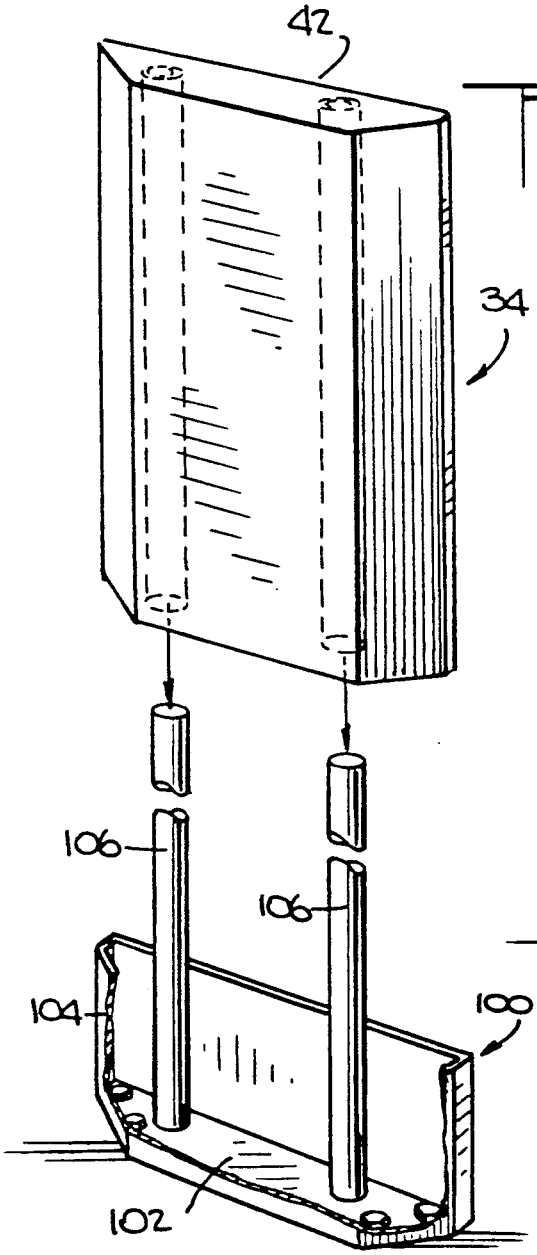

FIGS. 5–7 show the internal construction of the antenna assembly 34. Referring first to FIG. 5, it will be seen that the antenna assembly is contained within an outer casing formed of a rectangular back cover 40 and a box-like front cover 42. These covers are both formed of an electrically non-conductive and non-magnetic material such as vacuum formed ABS (Acryloritride Butadiene Styrene) or similar sheet plastic material. The front cover 42 has a rectangular front face 44 from which extend trapezoidal top and bottom walls 46 and slanting side walls 48. The back cover 40 is formed with forwardly extending flange tabs 50 along each of its edges and these flange tabs fit inside the edges of the top and bottom walls 46 and the side walls 48 of the front cover 42. Screws (not shown) extend through holes 52 in these flanges and walls to hold the back and front covers 40 and 42 together as a closed container.

A rectangular, electrically conductive panel 56 fits along the inside surface of the back cover 40. This panel may be of any electrically conductive non-magnetic material, such as copper or aluminum. A material that has been found to be especially advantageous is a laminated material comprising two sheets of aluminum separated by a low density polyethylene core. A material sold under the registered trademark Alucobond by Consolidated Aluminum, Composite Materials Division, 11960 Westline Industrial Drive, St. Louis, Mo. 63146 is suitable for this use.

A pair of narrow wooden mounting plates 58 extend along the elongated edges of the electrically conductive panel 56 just inside the forwardly extending flange tabs 50 of the back cover 40. These mounting plates are formed with slots 60 which are aligned with the holes 52 in the edges of the back and front covers 40 and 42 to accommodate the fastening screws. A pair of vertical plastic support tubes 62 extend along the mounting plates 58 near their inner longitudinal edges. The tubes 62 are held in spaced apart relation by means of upper and lower block shaped styrofoam tube spacers 64 positioned between the tubes 62 near their upper and lower ends.

Upper and lower wooden braces 66 also extend between the support tubes 62 near the tube spacers 64. These wooden braces have cutouts 68 to allow passage of blown-foam plastic material. A vertical spacer block 70 of styrofoam extends between the wooden braces 66.

A rectangular wooden transmitter support panel 72 is positioned over the plastic support tubes 62. This panel has upper and lower square cutouts 74 and a central vertically extending rectangular cutout 76. In assembly, the transmitter support panel is screwed to the edges of the wooden braces 66. Eight thin wooden spacer blocks 78 are provided on the outer surface of the transmitter support panel 72, one block at each of the corners of the two square cutouts 74. In addition two thick wooden spacer blocks 80 are provided on the outer surface of the transmitter support panel 72 near opposite diagonal corners of the rectangular cutout 76.

Two square shaped inner transmitter coils **82*a* and 82*b* are laid one over the other on the transmitter support panel 72. These inner transmitter coils extend around the thick wooden spacer blocks 80. Two rectangular shaped outer transmitter coils 84*a* and 84*b* are laid one over the other over the inner transmitter coils 82 and over the thin wooden spacer blocks 78. The total thickness of the two inner coils 82 is the same as that of each of the thin wooden spacer blocks 78, thus providing support in a flat plane for the outer transmitter coils 84. The outer transmitter coils 84 have the same width as the rectangular inner coils 82 but they are longer in the vertical direction and extend the full length of the transmitter support panel 72. The two inner transmitter coils 82 and the two outer transmitter coils 84** are each formed of twenty turns of copper wire and are all connected in series.

A rectangular receiver support panel 86 of wood, sheet plastic or cardboard is laid over the outer transmitter coils and is adhesively secured to the thick wooden spacer blocks 80. The thickness of the spacer blocks 80 is equal to the thickness of the two inner transmitter coils 82 plus the thickness of the two outer transmitter coils 84. Thus the receiver support panel 86 can lay over the outer transmitter support panels and contact the thick spacer blocks 80.

A pair of diagonally offset, partially overlapping rectangular receiver coils 88*a* and 88*b* are secured to the outer surface of the receiver support panel by means of tape 90.

Turning now to FIG. 6 it will be seen that in assembly the conductive panel 56 is fitted inside the flange tabs 50 of the back cover 40. Also, the wooden mounting plates 78 are positioned over the panel 56 along its outer vertical edges. The plastic support tubes 62, spacers 64 and 79 and braces 66 are positioned as above described and the wooden transmitter support panel 72 with its spacer blocks 78 and 80 is positioned over the plastic support tubes 62. The transmitter antenna coils 82 and 84 are mounted on the support panel 72 and the receiver support panel 86 with its receiver coils 88*a* and 88*b* is thereafter mounted over the outer transmitter antenna coils 84. As shown in FIG. 6, transmitter coil leads 90 extend from the transmitter antenna coils 82 and 84 to a terminal block 92 on one of the mounting plates 58. A capacitor 94 is also mounted on the one mounting plate 58 and is connected by leads 96 to the terminal block 92. In addition receiver coil leads 98 extend from the receiver coils 88*a* and 88*b* to the terminal block 92. Additional leads (not shown) connect the terminal block 92 to external transmitter and receiver elements.

When the various parts of the antenna assembly are arranged as above described the front cover 42 is put in place and is secured to the back cover 40 to complete the outer casing of the antenna assembly. Then blown-foam plastic is injected into the inside of the casing and caused to cure and expand therein to firmly hold all of the components in place as shown in FIG. 7. The antenna assembly may then be transported and moved without causing damage or misalignment of any of its components. Also, the conductive panel 56 is maintained in precise positioned relationship to the transmitter antenna coils 82 and 84 to ensure that the coils will have a predetermined amount of inductive preloading.

It will be appreciated that the blown-foam plastic does not extend inside the plastic support tubes 62. Instead these tubes remain hollow and open out at the bottom wall 46 of the front cover 42. The tubes 62 permit the antenna assembly 34 to be mounted quickly and easily as shown in FIGS. 8 and 9.

Figure 8:
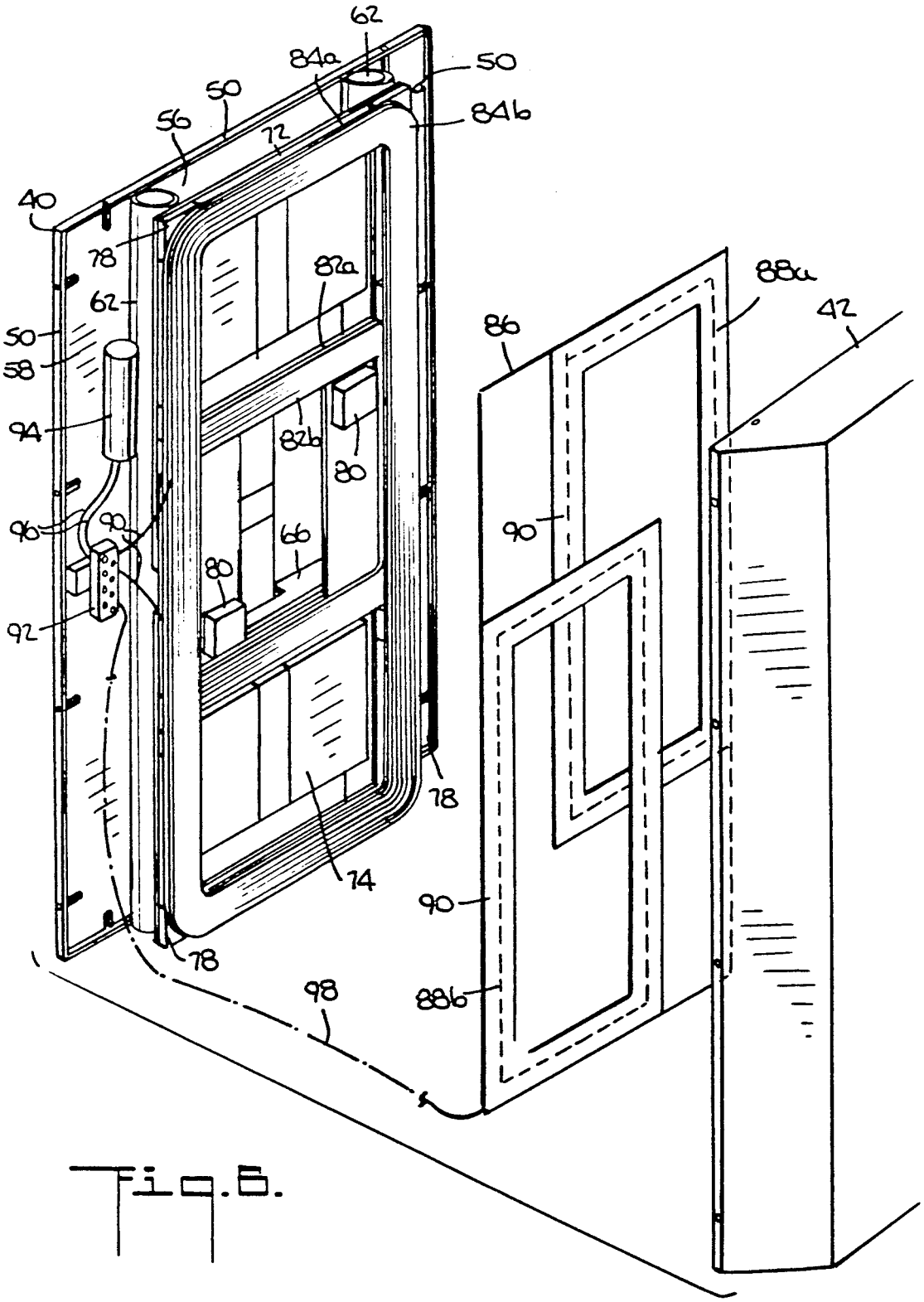
FIG. 8 is a perspective view showing the manner of mounting the assembled antenna assembly of FIG. 5.
Figure 9:
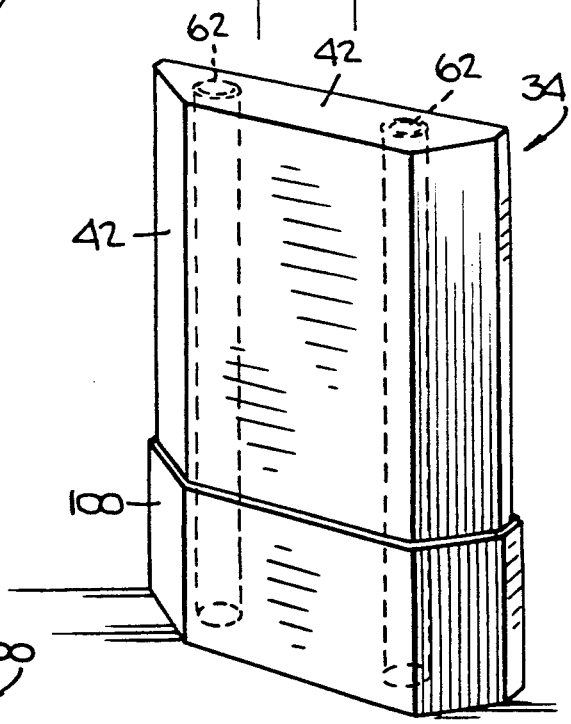
FIG. 9 is a perspective view similar to FIG. 8 but showing the antenna assembly in fully mounted condition.

As can be seen in FIG. 8 a boot-like mounting assembly 100 is provided for mounting the antenna assembly 34. The mounting assembly 100 comprises a base plate 102, which may be secured to a floor by means of bolts 102 or other suitable fastening means, a boot 104 extending up from the edges of the base plate 102 and a pair of wooden mounting pins 106 extending up from the base plate 102 inside the boot 104. The boot 104 is open at its upper end and has an interior cross section corresponding to the exterior cross section of the antenna assembly 34. Also, the wooden mounting pins 106 are positioned and dimensioned to fit closely inside the plastic support tubes 62.

To mount the antenna assembly 34, the mounting assembly 100 is first secured to the floor at a desired location. Then the antenna assembly 34 is lifted over the wooden mounting pins 106 and lowered so that the pins project up into the support tubes 62. The antenna assembly 34 is lowered further on the pins 106 until the lower end of its outer casing telescopes inside the boot 104 of the mounting assembly 100 as shown in FIG. 9. The antenna assembly 34 is thus securely mounted without need for any special fasteners or tools.

Figure 10A:
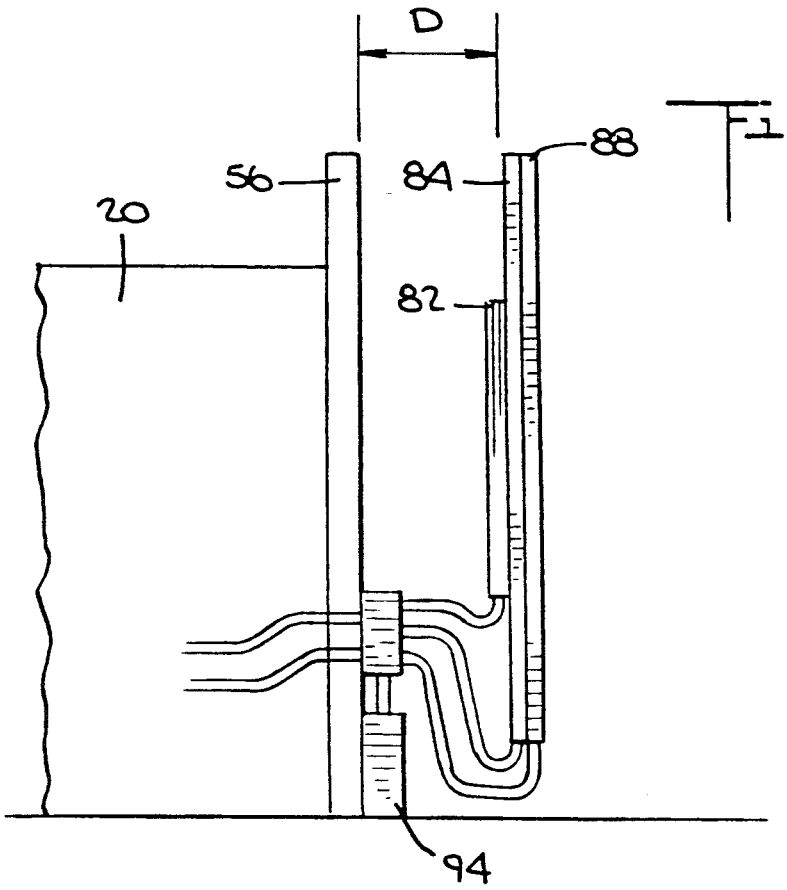
FIG. 10A is a diagrammatic side elevational view of the antenna assembly FIG. 6.
Figure 10B:
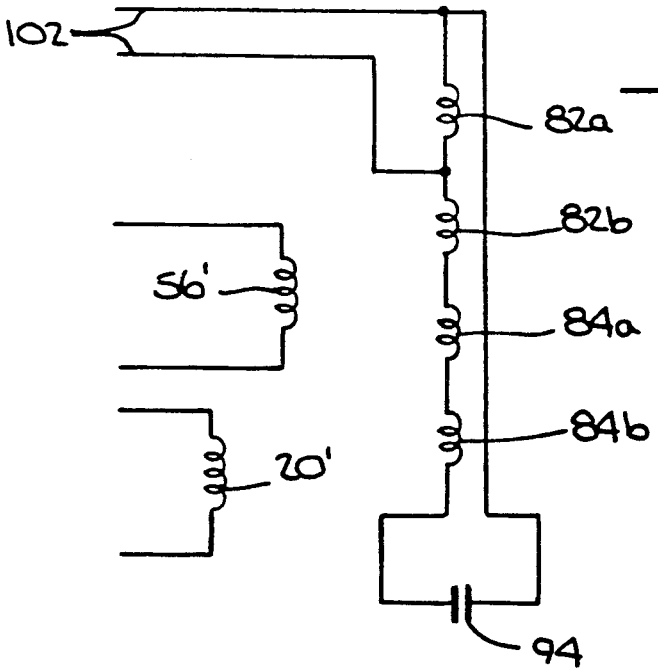
FIG. 10B is a schematic representation of a transmitter antenna circuit used in the antenna assembly of FIG. 6.

FIGS. 10A and 10B show the manner in which the antenna assembly 34 is arranged to provide isolation from the effects of nearby metal objects such as checkout counters. As shown in FIG. 10A, the transmitter antenna coils 82 and 84 are spaced apart from the conductive panel 56 by a distance D, and the counter 20 is located on the opposite side of and immediately adjacent the panel 56. FIG. 10B shows an equivalent circuit for the transmitter antenna coils, the conductive panel 56' and the counter 20'. As can be seen in FIG. 10B, the coils 82*a*, 82*b*, 84*a* and 84*b* are connected in series with each other and the capacitor 94 is connected across the coils 82 and 84 to form a resonant circuit therewith. A pair of input lines 102 is connected across one of the coils 82. An alternating current at the interrogation frequency of the system e.g., 218.68 Hz (hertz) is applied via the lines 102 to the coils 82 and 84 and the capacitor 94.

The inductance of the coils 82 and 84 and the capacitance of the capacitor 94 are chosen such that the resonant circuit formed by these elements resonates at the interrogation frequency of the system. This enables large values of electrical current to flow through the antenna coils 82 and 84 and to generate large magnetic interrogation fields without need to supply high electrical currents to the antenna system. It is important however that the antenna circuit resonate at or close to the interrogation frequency of the system, otherwise these current amplifying effects will be lost.

It is possible, by properly tuning the capacitor 94, to cause the antenna circuit to resonate precisely at the interrogation frequency. However, if large electrically conductive objects are located near the antenna coils, those objects will inductively couple with the antenna coils and produce a change in the overall inductance of the resonant circuit thereby causing it to resonate at a different frequency. Although it is possible to compensate for such resonant frequency shifts by adjusting the capacitor 94, it is often not practical to make such adjustments each time a metal object is brought near the antenna coils nor is it always practical to make such adjustment when installing the antenna coils near a checkout counter whose size and metal composition may affect the circuit inductance in an indeterminant manner.

The electrically conductive panel 56 of the present invention overcomes this problem by providing an inductive preload of fixed amount on the antenna coils 82 and 84. This panel may be represented schematically, as shown in FIG. 10B, by a parallel loop 56'. This loop provides a substantial yet fixed reduction in the overall inductance of the coils; and the capacitor 94 is adjusted to cause the circuit, with the panel 56 in place, to resonate at the system interrogation frequency. Because of this large preloading, the additional loading effects of the counter 20 (which may also be represented by a parallel loop 20' as in FIG. 10B) are minimized. In other words, while the counter 20 may make a substantial change in the overall inductance of the coils 82 and 84 alone, the counter does not make nearly so substantial a change in the case where the coils 82 and 84 are already preloaded by the conductive panel 56.

Figure 11:
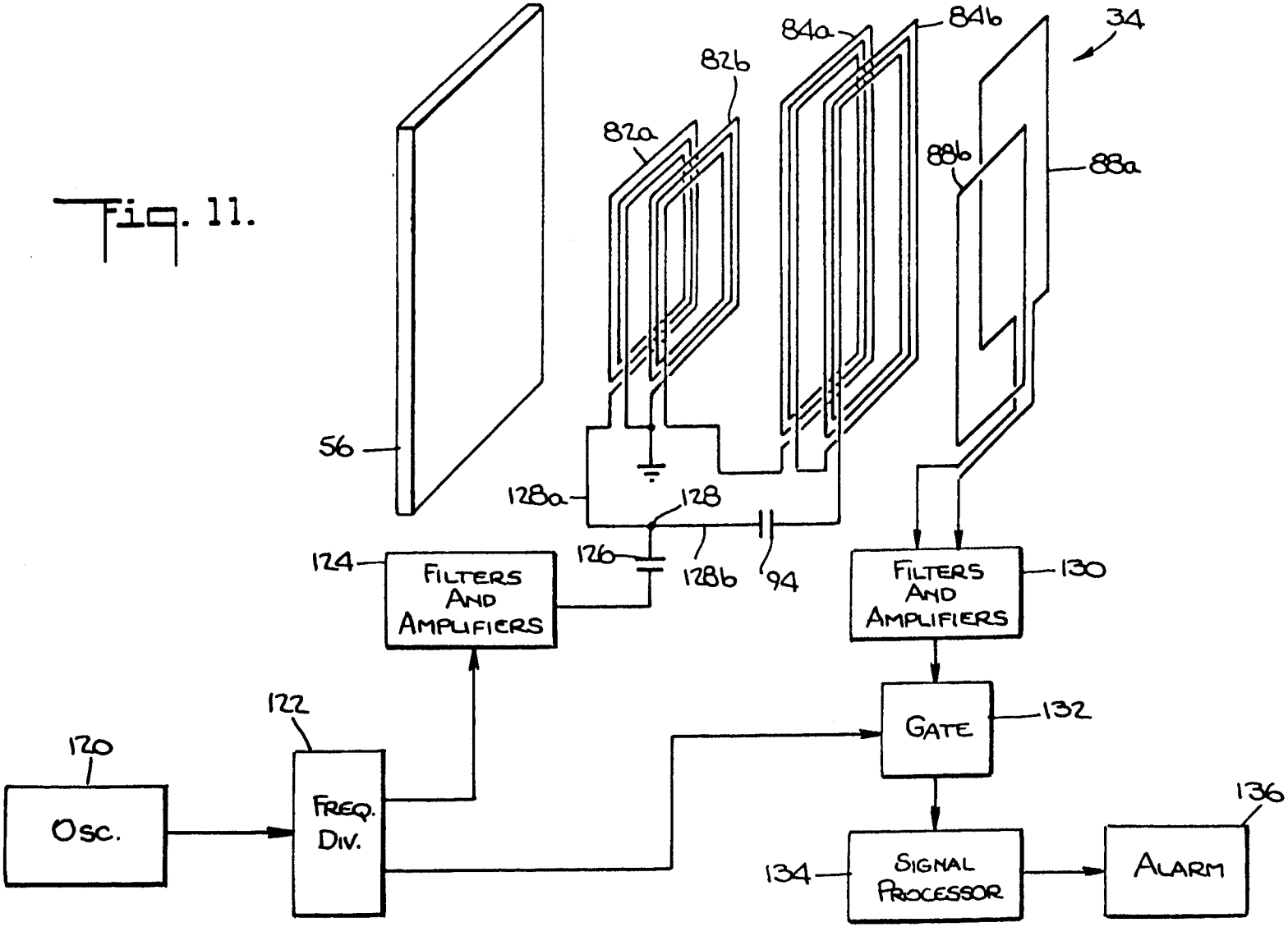
FIG. 11 is a block diagram of a detection system according to the present invention.

FIG. 11 shows a detection system and antenna arrangement according to the present invention. As can be seen in FIG. 11, there is provided an oscillator 120, which may be crystal controlled and which oscillates at some multiple of the system frequency. The output of the oscillator 120 is supplied to a frequency divider 122 which divides the oscillator frequency down to the system frequency and supplies a signal at the system frequency to filters and amplifiers 124 which produce a large amplitude sine wave current signal to the antenna assembly 34. The precise construction of the oscillator 120, the frequency divider 122 and the filters and amplifiers 124 is not critical to a part of this invention and therefore is not described in detail herein. For further detail, reference is made to U.S. Pat. No. 4,623,877.

The output of the filters and amplifiers 124 is supplied through a blocking capacitor 126 to a junction 128. A first branch 128*a* from the junction is connected to one end of an inner transmitter coil 82*a*. The other end of the coil 82*a* is connected to the ground as well as to one end of another inner transmitter coil 82*b* which is connected to one end of an outer transmitter coil 84*a*. The other end of the coil 84*a* is connected to the end of another outer transmitter coil 84*b*. The coils 82*a*, 82*b*, 84*a* and 84*b* are all wound in the same direction so that current always flows in the same direction through each coil. The other end of the outer transmitter coil 84*b* is connected to one side of the capacitor 94. The other side of the capacitor 94 is connected via a second branch 128*b* to the junction 128.

It will thus be seen that the antenna coils 82*a*, 82*b*, 84*a* and 84*b* are connected to each other in series and that the capacitor 94 is connected across the antenna coil arrangement to form a resonant circuit. In addition, the first inner antenna coil 82*a* is connected between the output of the filters and amplifiers 124 (via the blocking capacitor 126) and ground. In this arrangement a relatively small amplitude current signal applied from the filters and amplifiers 124 to the coil 82*a* is transformed in the resonant circuit made up of the four series connected coils 82*a*, 82*b*, 84*a* and 84*b* and the capacitor 94 to a very large amplitude current which in turn produces a large alternating magnetic field in the region of the coils.

The electrically conductive panel 56, as explained above, preloads the resonant antenna circuit and electrically resembles a parallel connected inductance in the circuit. Accordingly, the capacitance value of the capacitor 94 is set to cause the antenna circuit to resonate at the system frequency under conditions where the conductive panel 56 is positioned at a predetermined distance from the transmitter antenna coils 82 and 84 in the antenna assembly.

The distance of the conductive panel 56 from the transmitter antenna coils 82 and 84 and the size of the conductive panel 56 have an effect on the performance of the system. As the conductive panel 56 is brought closer to the antenna coils 82 and 84 it causes an increase in inductive loading. As a result the isolation of the antenna assembly from the determining effects of nearby metallic objects is greatly enhanced. However, as the conductive panel 56 is moved closer to the antenna coils 82 and 84 it causes the magnetic fields generated by the antenna coils to be concentrated more strongly in the region between the panel and the transmitter antenna coils and thereby limits the effective range of detectability of the system. It has been found preferable to position the conductive panel 56 about three and five eighths inches (9.2 cm) away from the transmitter coils. At this spacing an optimum compromise is achieved between desired loading isolation and undesired range restriction.

The inner transmitter antenna coils 82*a* and 82*b* in the preferred embodiment are each made up of forty turns in a square configuration of fifteen and three quarter inches by fifteen and three quarter inches (40 cm×40 cm). The outer transmitter coils are each made up of forty turns in a rectangular configuration of fifteen and three quarter inches (40 cm) by thirty nine and one eighth inches (99.4 cm). The total inductance of the coils 82*a*, 82*b*, 84*a* and 84*b* is 21.19 millihenries. However, the loading effect of the conductive panel 56 results in an overall inductance of 16.9 millihenries. The capacitor 94 is thus set at a value of 31.35 microfarads to provide a resonant frequency of 218.68 Hz.

The conductive panel 56 provides, in addition to the above described preloading effects, a further isolation effect whereby targets located on a counter can pass very close to the antenna assembly without causing the system to produce an alarm. This is especially important in so-called "passaround" systems wherein the targets are neither deactivated nor removed from protected articles at the point of sale. In such cases the sales clerk simply moves each article along the counter 20 as he or she rings up the sale of the article and the customer then picks up the articles at a location beyond the antenna assembly. Since the targets on the articles are in active, i.e., detectable, condition, it is important that the detection system not react to them as they move along the counter 20.

It has been found that the phase relationship between the antenna interrogation field and target responses is significantly altered when the targets are located on the counter 20. This change in phase relationship is caused by the interrogation field passing through the conductive panel 56 to energize targets on the counter as well as by the return passage of the target disturbances back through the panel 56. The present invention, in this aspect, isolates the detection system from the disturbances produced by targets on the counter 20 by excluding signals which occur at the phase of those disturbances.

As shown in FIG. 11, the receiver coils 88*a* and 88*b*, which are diagonally offset, rectangular, single turn, series connected bucking loops, are connected to filters and amplifiers 130; and these in turn are connected via a gate 132 to a signal processor 134 and an alarm 136. The gate 132 is connected to allow detected signals from the receiver coils to pass through to the signal processor. The specific construction of the filters and amplifiers 130, the gate 132, the signal processor 134 and the alarm 136 is not critical to nor part of this invention and any well known circuits may be used, for example, the circuits shown and described in U.S. Pat. No. 4,823,877.

In the present invention the gate 132 is synchronized with the interrogation field and is arranged to allow detected signals from the receiver coils 88*a* and 88*b* to pass through to the signal processor 134 only during those portions of the interrogation field cycle which would cause a target in the interrogation zone to be energized, but not during those portions of the interrogation field cycle in which a disturbance from a target on the counter 20 is detected. As explained above, the disturbances or signals from targets on the counter 20 occur at a different time in relation to the interrogation signal and therefore, since the gate 132 does not pass signals during such times, the signals from targets on the counter 20 are not detected.

Figure 12:
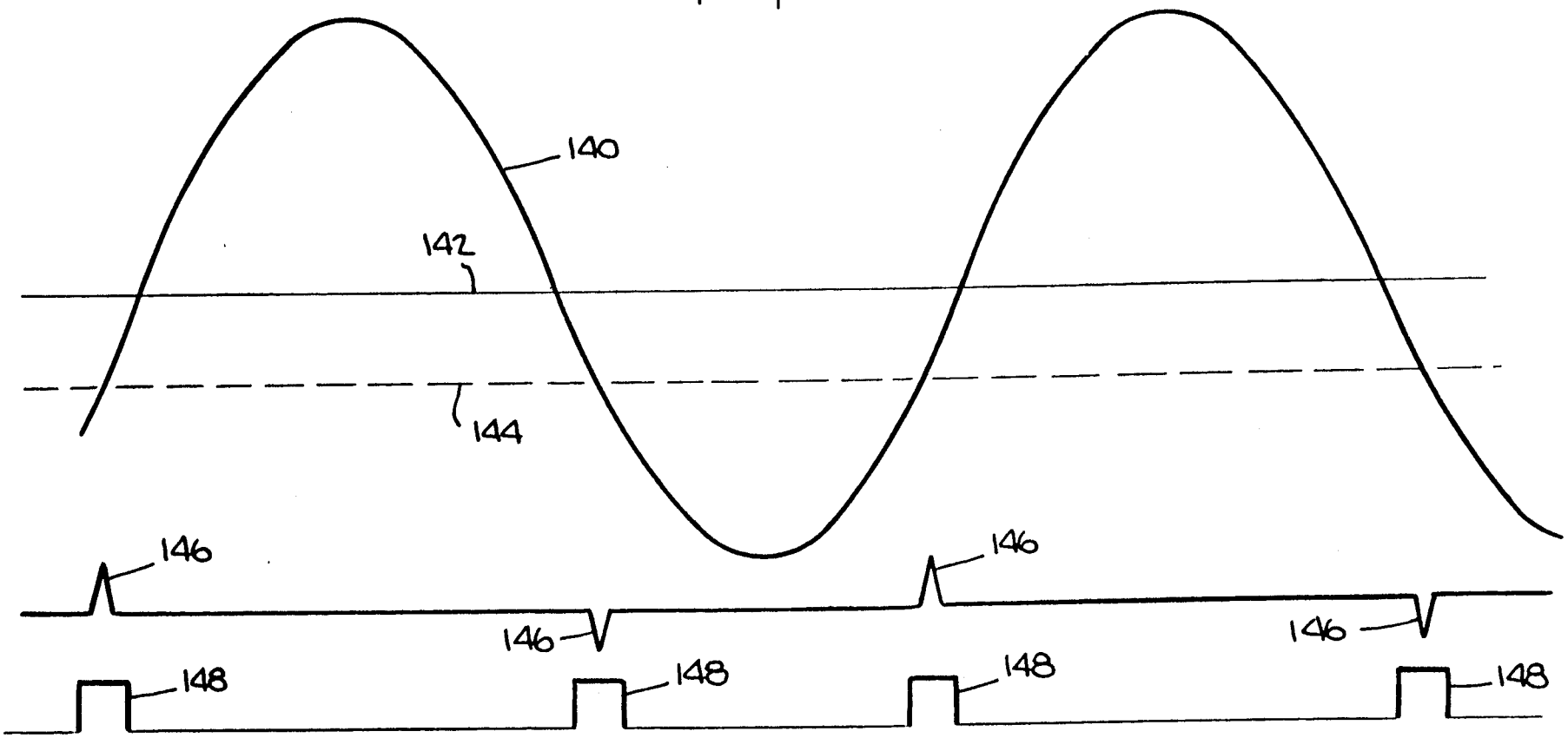
FIG. 12 is a set of waveforms showing the operation of the system shown in FIG. 11.

FIG. 12 shows an interrogation signal waveform 140 which is centered on a solid line horizontal axis 142. Because of the presence of the earth s magnetic field, the intensity of the field incident upon targets in the interrogation zone is biased, as represented by a dashed line horizontal axis 144. A target responds to an interrogation field whenever the target is switched from magnetic saturation in one direction to magnetic saturation in the opposite direction. Because of the biasing effect of the earth's magnetic field, the target responses occur at unevenly spaced intervals, as indicated by the pulses 146 in FIG. 12. Since true targets are affected by the earth's magnetic field to-a far greater extent than most other magnetic elements, the degree of unevenness in the spacing of the received signal responses is a strong indication of whether the responses are from a true target. In order to select those detected responses which occur with an unevenness corresponding to that caused by a true target, the gate 132 (FIG. 11) is arranged in conjunction with the output of the frequency divider 122 so that it allows received signals to pass through to the signal processor 134 only during predetermined times. Thus the gate is arranged to pass signals during intervals 148 in FIG. 12 which correspond to the pulses 146. Disturbances produced by targets on the counter 20 occur at other times relative to the phase of the interrogation field wave from 140 and therefore since the gate 132 does not allow signals to pass through to the signal processor during those other times, the disturbances produced by targets on the counter 20 are not detected.

The gates shown in U.S. Pat. No. 4,623,877 are described as being used to exclude signals which occur when the interrogation field is at an intensity sufficient to saturate metal objects which are not targets. Subsequent to the issuance of U.S. Pat. No. 4,623,877 further refinements were made according to which the gates were allowed to pass signals which occurred at uneven intervals to select those signals produced by true targets which are greatly affected by the earth's magnetic field and which produce disturbances at uneven intervals because of the earth's magnetic field. However, those further refinements were not used to isolate the system from detecting true targets positioned on a counter behind an electrically conductive panel; and that difference constitutes the novelty of one aspect of this invention.

It has also been found that the shielding and isolation effects of the conductive panel 56 is optimized if it is made larger than the interrogation antenna. In the preferred embodiment the external dimensions of the panel 56 are twenty three and three eights inches (59.4 cm) by thirty nine and one eighth inches (99.4 cm). Thus the width of the panel 56 exceeds the width of the interrogation antenna coils 82 and 84 by seven and five eighths inches (19.37 cm). The height of the panel 56 is shown to be essentially the same as that of the interrogation antennas. As a result the amount of shielding and isolation achieved in the regions above and below the antenna coils is not as great as that achieved at the sides of the coils; but it is not important in most cases to provide such shielding and isolation above and below the coils. Of course, if desired, the height of the panel 56 could be increased beyond that of the antenna coils 84 to increase the shielding and isolation in those regions as well.

We claim:

1. An electronic article surveillance system for detecting the unauthorized movement of protected articles, said system comprising a transmitter antenna assembly including a transmitter loop antenna lying in a flat plane and a capacitor connected to said transmitter loop antenna to form a resonant circuit therewith, a flat panel of electrically conductive material extending parallel to and aligned with said transmitter antenna, a receiver loop antenna arranged parallel to and aligned with said transmitter antenna and located on the same side of said panel as said transmitter antenna, a signal generator arranged to drive said transmitter antenna assembly at its resonant frequency, a receiver connected to said receiver loop antenna to process electrical signals generated by said receiver loop antenna and to detect those signals which result from the presence of a detectable target in the vicinity of said antennas, said receiver including gates synchronized with said signal generator to permit detection only of signals which occur at predetermined phase relationships relative to the phase of the signal generator, said gate being synchronized with said signal generator such that it does not pass signals during intervals of the driving of the transmitter antenna assembly which correspond to the occurrence of received disturbances caused by the presence of targets on the opposite side of said panel from said transmitter loop antenna.

* * * * *